US006526752B2

(12) United States Patent
McKinley et al.

(10) Patent No.: US 6,526,752 B2
(45) Date of Patent: Mar. 4, 2003

(54) PASSIVE ENGINE EXHAUST FLOW RESTRICTION ARRANGEMENT

(75) Inventors: Thomas L. McKinley, Columbus, IN (US); John M. Mulloy, Columbus, IN (US); Philip Dimpelfeld, Columbus, IN (US)

(73) Assignee: Cummins, Inc., Columbus, IN (US)

( * ) Notice: Subject to any disclaimer, the term of this patent is extended or adjusted under 35 U.S.C. 154(b) by 79 days.

(21) Appl. No.: 09/773,244

(22) Filed: Jan. 31, 2001

(65) Prior Publication Data

US 2002/0100280 A1 Aug. 1, 2002

(51) Int. Cl.[7] ..... F02B 33/44; F01N 7/00

(52) U.S. Cl. ..... 60/605.2; 60/324

(58) Field of Search ..... 60/605.2, 324; 138/44; 137/160, 468; 123/568.11

(56) References Cited

U.S. PATENT DOCUMENTS

| | | | | | |
|---|---|---|---|---|---|
| 1,217,615 | A | * | 2/1917 | McDowell | 137/160 |
| 3,925,989 | A | | 12/1975 | Pustelnik | 60/605.2 |
| 4,023,365 | A | * | 5/1977 | van Ginhoven | 60/324 |
| 4,215,550 | A | | 8/1980 | Dinger et al. | 60/605.2 |
| 4,915,135 | A | * | 4/1990 | Kellenbarger et al. | 138/44 |
| 5,146,941 | A | * | 9/1992 | Statler | 137/468 |
| 6,065,459 | A | * | 5/2000 | Stevens | 123/590 |
| 6,138,649 | A | | 10/2000 | Khair et al. | |
| 6,343,594 | B1 | * | 2/2002 | Koeslin et al. | 123/568.11 |
| 6,354,084 | B1 | * | 3/2002 | McKinley et al. | 60/605.2 |
| 6,358,109 | B1 | * | 3/2002 | Neisen | 440/89 |

FOREIGN PATENT DOCUMENTS

| | | | |
|---|---|---|---|
| DE | 946 930 | 8/1956 | |
| DE | 26 20 594 | 11/1976 | 60/605.2 |
| DE | 32 18 156 | 11/1983 | 60/605.2 |
| DE | 43 19 380 | 12/1993 | 60/605.2 |
| EP | 531277 | 3/1993 | 60/605.2 |
| JP | 54-148927 | 11/1979 | 60/605.2 |
| JP | 05-71428 | 3/1993 | 60/605.2 |
| JP | 11125147 | 5/1999 | |
| WO | WO 92/16725 | 10/1992 | |
| WO | WO 01/46573 A1 | 6/2001 | |

* cited by examiner

*Primary Examiner*—Thomas Denion
*Assistant Examiner*—Thai-B Trieu
(74) *Attorney, Agent, or Firm*—Cummins, Inc.

(57) ABSTRACT

A passive engine exhaust flow restriction arrangement includes a fixed geometry flow restriction mechanism disposed in line with an exhaust conduit. In one embodiment, the flow restriction mechanism is disposed upstream of a turbocharger turbine, and in an alternate embodiment it is disposed downstream of the turbine. In either case, the flow restriction mechanism defines a fixed cross sectional flow area therethrough that is less than the cross sectional flow area of the exhaust conduit. Preferably, the cross sectional flow area of the flow restriction mechanism is sized to optimize one, or both, of turbine efficiency and engine fuel economy.

13 Claims, 3 Drawing Sheets

PASSIVE ENGINE EXHAUST FLOW RESTRICTION ARRANGEMENT

FIELD OF THE INVENTION

The present invention relates generally to mechanisms for optimizing the operational efficiency of a turbocharger for an internal combustion engine, and more specifically to mechanisms for restricting engine exhaust flow supplied to and/or by a turbocharger turbine.

BACKGROUND OF THE INVENTION

Exhaust gas recirculation (EGR) systems for internal combustion engines are known and are generally operable to selectively direct exhaust gas produced by the engine back into the fresh charge supplied to the air intake system for the purpose of controlling $NO_x$ emissions. In order to establish a positive flow of exhaust gas into the fresh air stream, the exhaust gas pressure must necessarily be greater than the intake air pressure. This requirement may be compromised in air handling systems including a turbocharger, and conventional turbocharger/EGR control systems accordingly include one or more mechanisms for managing turbocharger swallowing capacity in order to provide adequate back pressure to ensure positive EGR flow.

One known technique for ensuring positive EGR flow requires sizing the dimensions of the turbocharger turbine to provide a fixed geometry that is small enough to ensure positive EGR flow under all expected engine operating conditions. Alternatively, the turbocharger turbine may be configured to have a variable geometry, wherein the swallowing capacity of the turbine may be controlled by controlling the air flow geometry thereof. Alternatively still, the air handling system may include a wastegate operable to selectively direct exhaust gas around the turbocharger turbine in order to modulate the exhaust gas pressure.

While the foregoing techniques for ensuring positive EGR flow are generally operable to accomplish their particular goals, they have certain drawbacks associated therewith. For example, reducing the swallowing capacity of the turbocharger also has the undesirable effect of increasing the intake manifold pressure. If the turbine efficiency is higher than desired, the net result will be higher than desired turbocharger rotor speed, turbocharger outlet pressure, cylinder pressure and engine heat rejection. Moreover, fuel economy will suffer and soot loading of the oil will be worsened.

If the "apparent" turbine efficiency can be managed without changing its physical air swallowing capacity, several operational advantages can be realized. For example, the EGR rate can then be increased so that injection timing can be advanced and fuel consumption thereby improved. Boost pressure can also be lowered, thereby increasing available engine power. Moreover, a larger geometry turbine can be used to allow for improvement in high speed power and fuel economy.

One known mechanism for managing apparent turbine efficiency is a variable flow rate exhaust throttle that typically includes a valve or similar mechanism that may be selectively controlled to correspondingly reduce or enlarge the effective flow area of the exhaust conduit. However, while such devices are generally operable to achieve their designed function, they are typically unreliable in operation. Moreover, such variable flow rate exhaust throttles undesirably add weight and significant cost to the air handling system. What is therefore needed is a simple, reliable and inexpensive mechanism for optimizing the apparent turbine efficiency to thereby improve engine output power and controllability.

SUMMARY OF THE INVENTION

The foregoing shortcomings of the prior art are addressed by the present invention. In accordance with one aspect of the present invention, a passive engine exhaust flow restriction arrangement comprises a turbocharger having a turbocharger turbine defining a turbine inlet operable to receive exhaust gas produced by an internal combustion engine and a turbine outlet operable to expel engine exhaust gas therefrom, a first engine exhaust conduit in fluid communication with the turbine inlet and defining a first cross sectional flow area therethrough, a second engine exhaust conduit in fluid communication with the turbine outlet and defining a second cross sectional flow area therethrough, and a passive flow restriction member disposed in line with either of the first and second engine exhaust conduits and defining a third fixed cross sectional flow area therethrough less than either of the first and second cross sectional flow areas.

In accordance with another aspect of the present invention, A passive engine exhaust flow restriction arrangement comprises a turbocharger having a turbocharger turbine defining a turbine inlet operable to receive exhaust gas produced by an internal combustion engine and a turbine outlet operable to expel engine exhaust gas therefrom, an exhaust conduit disposed in fluid communication an exhaust manifold of the engine and the turbine inlet, the exhaust conduit defining a first cross sectional flow area therethrough, and a passive flow restriction member disposed in line with the exhaust conduit and defining a second fixed cross sectional flow area therethrough less than the first cross sectional flow area.

In accordance with yet another aspect of the present invention, a passive engine exhaust flow restriction arrangement comprises a turbocharger having a turbocharger turbine defining a turbine inlet operable to receive exhaust gas produced by an internal combustion engine and a turbine outlet operable to expel engine exhaust gas therefrom, an exhaust conduit disposed in fluid communication between the turbine outlet and ambient, the exhaust conduit defining a first cross sectional flow area therethrough, and a passive flow restriction member disposed in line with the exhaust conduit and defining a second fixed cross sectional flow area therethrough less than the first cross sectional flow area.

One object of the present invention is to provide a passive engine exhaust flow restriction arrangement defining a fixed cross sectional flow area therethrough.

Another object of the present invention is to size such an exhaust flow restriction arrangement to optimize turbocharger turbine efficiency.

Yet another object of the present invention is to size such an exhaust flow restriction arrangement to optimize engine fuel economy.

These and other objects of the present invention will become more apparent from the following description of the preferred embodiment.

DESCRIPTION OF THE PREFERRED EMBODIMENTS

Figure 1:
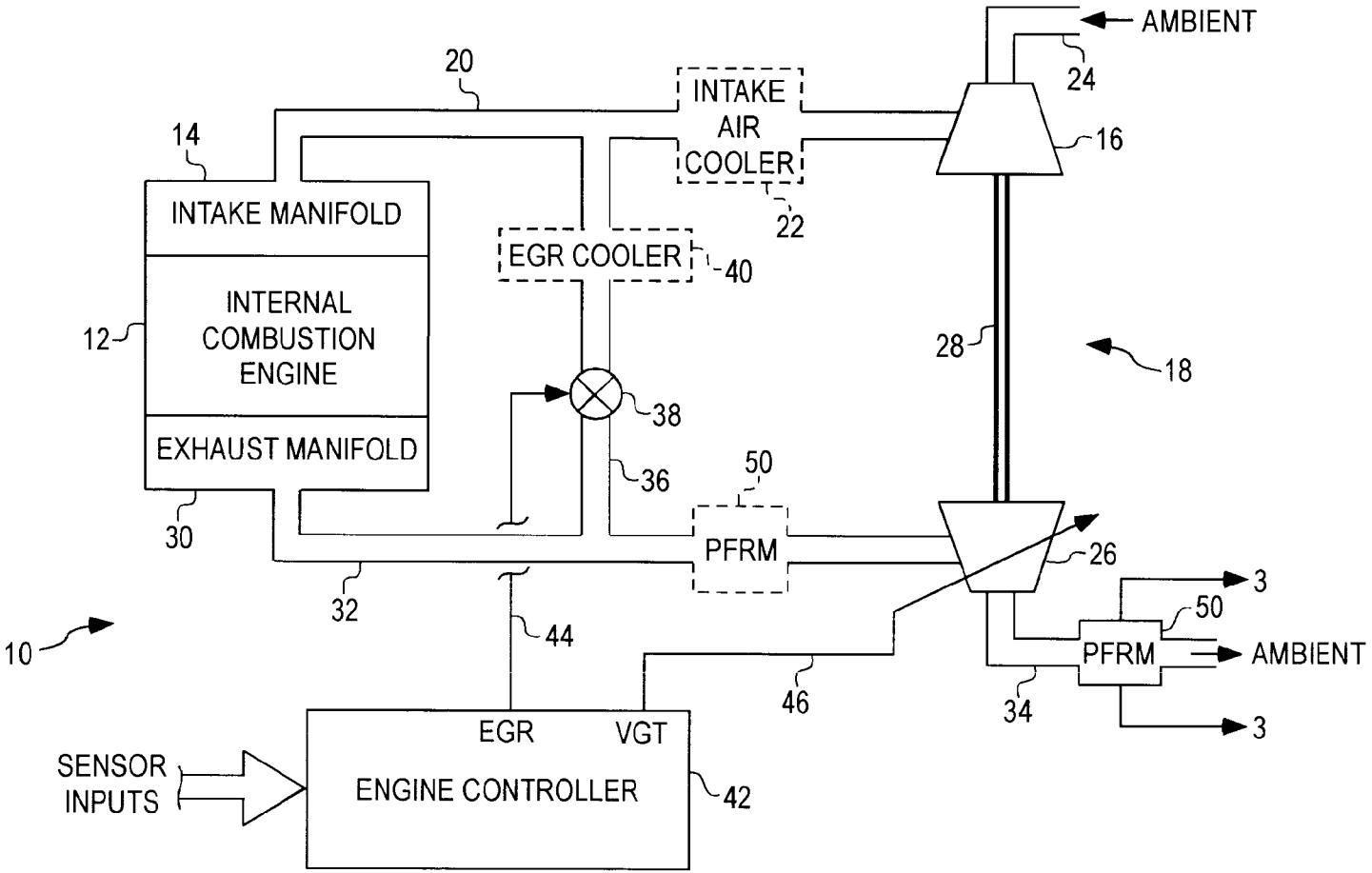
FIG. 1 is a diagrammatic illustration of one preferred embodiment of an air handling system for an internal combustion engine including a passive exhaust flow restriction arrangement, in accordance with the present invention.

For the purposes of promoting an understanding of the principles of the invention, reference will now be made to a number of preferred embodiments illustrated in the drawings and specific language will be used to describe the same. It will nevertheless be understood that no limitation of the scope of the invention is thereby intended, such alterations and further modifications in the illustrated embodiments, and such further applications of the principles of the invention as illustrated therein being contemplated as would normally occur to one skilled in the art to which the invention relates.

Referring now to FIG. 1, one preferred embodiment of an air handling system 10 for an internal combustion engine including a passive exhaust flow restriction arrangement, in accordance with the present invention, is shown. System 10 includes an internal combustion engine 12 having an intake manifold 14 fluidly coupled to an outlet of a compressor 16 of a turbocharger 18 via an intake conduit 20, wherein the compressor 16 includes a compressor inlet coupled to an intake conduit 24 for receiving fresh air therefrom. Optionally, as shown in phantom in FIG. 1, system 10 may include an intake air cooler 22 of known construction disposed in line with intake conduit 20 between the turbocharger compressor 16 and the intake manifold 14. The turbocharger compressor 16 is mechanically coupled to a turbocharger turbine 26 via a drive shaft 28, wherein turbine 26 includes a turbine inlet fluidly coupled to an exhaust manifold 30 of engine 12 via an exhaust conduit 32, and further includes a turbine outlet fluidly coupled to ambient via an exhaust conduit 34. An EGR valve 38 is disposed in line with an EGR conduit 36 disposed in fluid communication with the intake conduit 20 and the exhaust conduit 32, and an EGR cooler 40 of known construction may optionally be disposed in line with EGR conduit 36 between EGR valve 38 and intake conduit 20 as shown in phantom in FIG. 1.

System 10 includes an engine controller 42 that is preferably microprocessor-based and is generally operable to control and manage the overall operation of engine 12. Engine controller 42 is responsive, at least in part, to a number of sensor input signals to produce an EGR control signal at an EGR output thereof. The EGR output of engine controller 42 is electrically connected to EGR valve 38 via signal path 44, and controller 42 is operable, as is known in the art, to thereby control the flow of exhaust gas between conduit 32 and conduit 20. Engine controller 42 is further responsive to one or more of the sensor input signals to produce a variable geometry turbocharger control signal at a VGT output thereof. The VGT output of engine controller 42 is electrically connected to a turbine control mechanism via signal path 46, wherein the turbine control mechanism may be an electronically controllable variable geometry turbocharger and/or an electronically controllable wastegate. In this case, controller 42 is operable, as is known in the art, to control such a turbine control mechanism via the VGT output. Alternatively, the turbine control mechanism may be a mechanically, pneumatically and/or hydraulically actuatable wastegate or variable geometry turbocharger, in which case control thereof may or may not be assisted by controller 42.

In accordance with one preferred embodiment of the present invention, exhaust conduit 34 includes a passive flow restriction mechanism (PFRM) 50 disposed in line therewith. In this embodiment, exhaust conduit 34 defines a first cross sectional flow area therethrough and flow restriction mechanism 50 defines a second, reduced cross sectional flow therethrough. In an alternative embodiment of the present invention, the passive flow restriction mechanism (PFRM) 50 may be disposed in line with exhaust conduit 32, wherein exhaust conduit defines a third cross sectional flow area therethrough that is greater than the second cross sectional flow area defined by the flow restriction mechanism 50. It is to be understood that the first cross sectional flow area defined by exhaust conduit 34 may or may not be the same as the third cross sectional flow area defined by exhaust conduit 32, but in any case both are larger in cross sectional flow area than that defined by the flow restriction mechanism 50.

Figure 2:
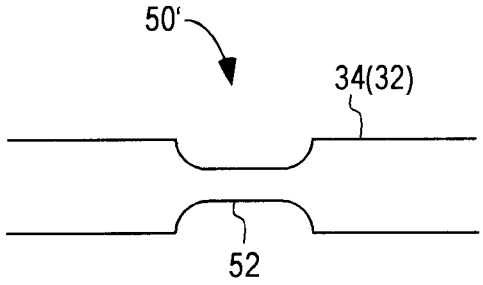
FIG. 2 is a diagrammatic illustration of one preferred embodiment of a passive engine exhaust flow restriction arrangement, in accordance with the present invention.
Figure 3:
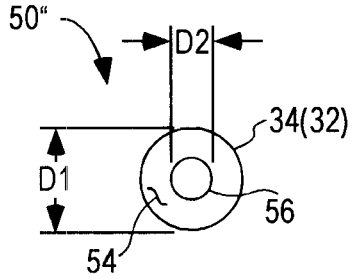
FIG. 3 is a cross-sectional diagram of an alternate embodiment of a passive engine exhaust flow restriction arrangement viewed along section lines 3—3 of FIG. 1, in accordance with the present invention.

Referring now to FIG. 2, one preferred embodiment 50' of either flow restriction mechanism 50 of FIG. 1, in accordance with the present invention, is shown. In this embodiment, flow restriction 50' preferably comprises a section of exhaust conduit 32 or 34 that is reduced in cross sectional flow area and thus defines a venturi 52. Referring to FIG. 3, an alternate embodiment 50" of either flow restriction mechanism 50 of FIG. 1, in accordance with the present invention. In this embodiment, the flow restriction mechanism 50" preferably comprises a plate or shield 54 disposed within exhaust conduit 32 or 34 and defining an orifice 56 therethrough. In this embodiment, the exhaust conduit 32 or 34 is shown as having a circular cross section defining a diameter D1, and orifice 56 is shown as having a circular cross section defining a diameter D2, wherein D2<D1. It is to be understood, however, that the cross sectional flow areas of either one or both of the exhaust conduit 32 (or 34) and orifice 56 may alternatively have a non-circular cross section.

Figure 4:
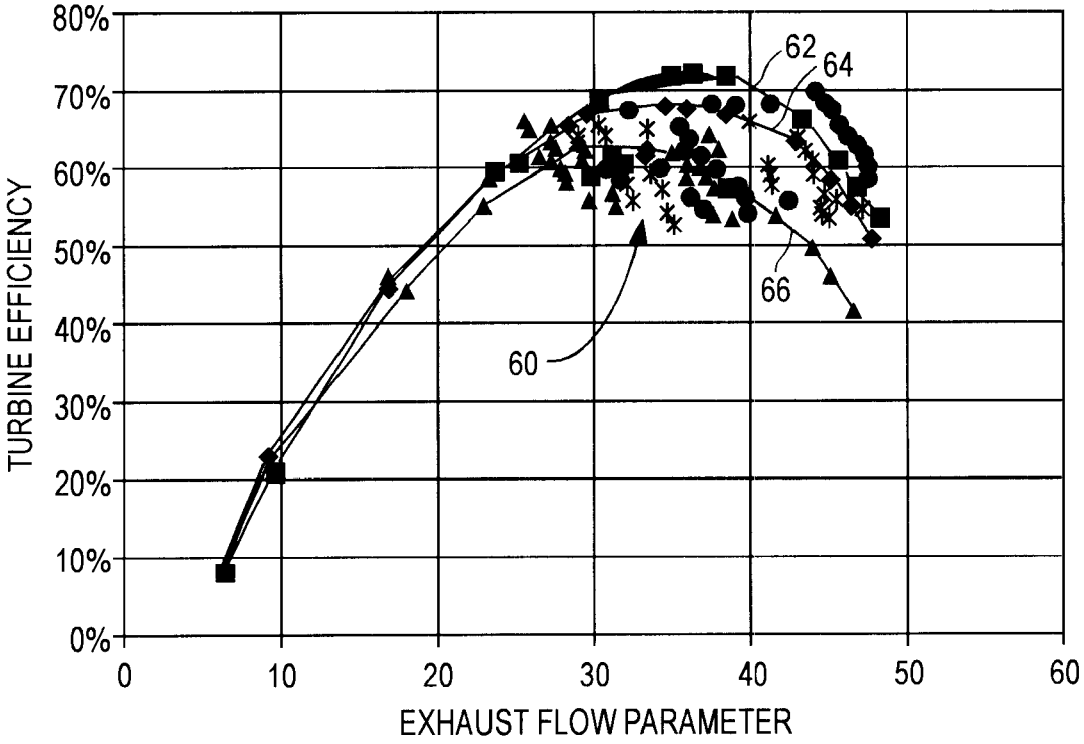
FIG. 4 is a plot of turbine efficiency vs. exhaust flow comparing turbine efficiencies resulting from a number of passive engine exhaust flow restriction mechanisms each defining different effective flow areas.

Referring now to FIG. 4, a plot of turbine efficiency vs. exhaust flow through an exhaust conduit such as conduit 32 or 34, is shown for a number of different cross sectional flow areas therethrough. For example, curve 62 corresponds to the case where the flow through conduit 32 or 34 is unrestricted (i.e., without flow restriction mechanism 50), curve 64 corresponds to a flow restriction mechanism defining a 3.0 $in^2$ cross sectional flow area therethrough and curve 66 corresponds to a flow restriction mechanism defining a 2.5 $in^2$ cross sectional flow area therethrough. Also superimposed onto the plot are a number of optimal turbine efficiency/flow parameter operating points 60 for various combinations of engine speed and altitude. Inspection of the plot of FIG. 4 reveals that the optimum turbine efficiency/flow parameter operating points tend to be closely grouped about curve 66, thereby indicating that turbine efficiency can be roughly optimized for the air handling system represented by the plot of FIG. 4 by implementing a flow restriction device 50 defining a cross sectional flow area therethrough of approximately 2.5 $in^2$. Naturally, optimum turbine efficiency is a dynamic variable and can therefore be more accurately controlled with a variable geometry flow restriction device, but only at the expense of more weight, higher cost and much lower reliability than the passive, fixed orifice flow restriction mechanism 50 of the present invention. Although not as accurate as a variable geometry flow restriction device, the flow restriction mechanism 50 of the present invention can be sized to allow the "apparent" turbine efficiency to be much closer to its optimum value without the cost, weight and reliability concerns associated with the variable geometry device.

Figure 5:
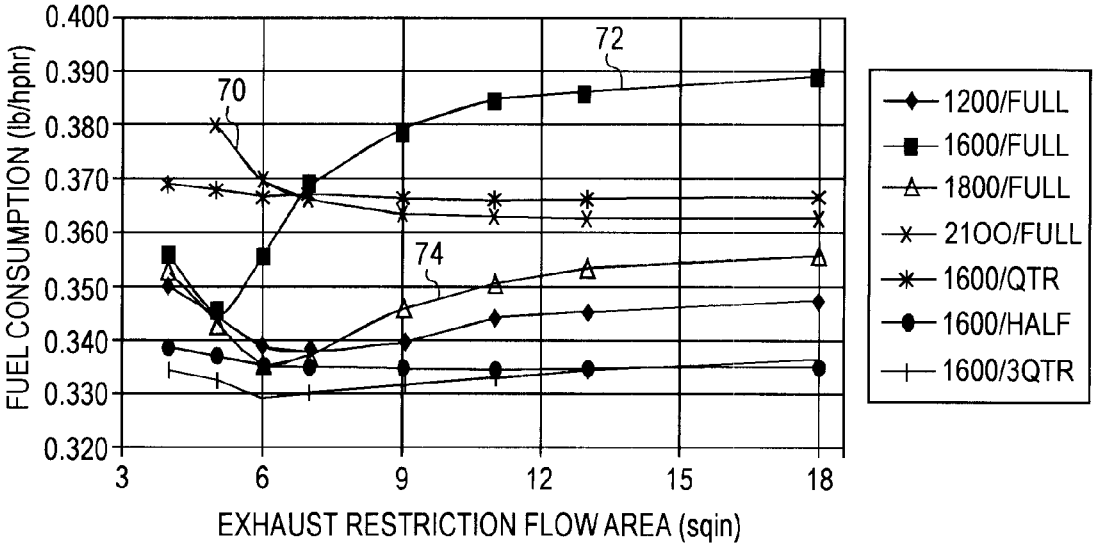
FIG. 5 is a plot of engine fuel consumption vs. exhaust restriction flow area illustrating the effect on fuel economy of different exhaust restriction flow areas.

Referring now to FIG. 5, a plot of fuel consumption vs. exhaust restriction flow area through an exhaust conduit such as conduit 32 or 34, is shown for a number of different engine speed/throttle combinations. For example, curve 70 corresponds to 2100 RPM at full throttle, curve 72 corresponds to 1600 RPM at full throttle and curve 74 corresponds to 1800 RPM at full throttle. Other engine speed/throttle combinations are shown, but the consistent behavior for each engine speed throttle combination indicates that there exists a flow restriction cross sectional area that roughly optimizes fuel consumption for all engine speed/throttle combinations. As with turbine efficiency, however, optimum fuel consumption is a dynamic variable and can therefore be more accurately controlled with a variable geometry flow restriction device. However, the fixed geometry flow restriction mechanism 50 of the present invention realizes most of the same improvement as a variable geometry flow restriction device without the cost, weight and reliability concerns associated with variable geometry devices.

Preferably, the size of the cross sectional flow area defined by the flow restriction mechanism 50 of the present invention is chosen based on optimization considerations of both turbine efficiency and fuel consumption, and will often involve a tradeoff between the two. Alternatively, the size of the cross sectional flow area defined by the flow restriction mechanism 50 of the present invention may be chosen to optimize only one or the other of turbine efficiency and fuel consumption.

While the invention has been illustrated and described in detail in the foregoing drawings and description, the same is to be considered as illustrative and not restrictive in character, it being understood that only preferred embodiments thereof have been shown and described and that all changes and modifications that come within the spirit of the invention are desired to be protected.

What is claimed is:

1. A passive engine exhaust flow restriction arrangement, comprising:

a turbocharger having a turbine defining a turbine inlet operable to receive exhaust gas produced by an internal combustion engine and a turbine outlet operable to expel engine exhaust gas therefrom;

a first engine exhaust conduit in fluid communication with said turbine inlet and defining a third cross sectional flow area therethrough;

an EGR conduit fluidly coupled between said first engine exhaust conduit and an intake manifold of said engine, said EGR conduit supplying recirculated exhaust gas to said intake manifold;

a second engine exhaust conduit in fluid communication with said turbine outlet and defining a first cross sectional flow area therethrough; and a passive flow restriction member disposed in line with either of said first and second engine exhaust conduits downstream of said EGR conduit and defining a second fixed cross sectional flow area therethrough less than either of said first and third cross sectional flow areas, said second cross sectional flow area sized to reduce an operational efficiency of said turbine to thereby allow increased flow of said recirculated exhaust gas through said EGR conduit.

2. The exhaust flow restriction arrangement of claim 1 wherein said passive flow restriction member is disposed in line with said first engine exhaust conduit;

and wherein said passive flow restriction member comprises a section of said first engine exhaust conduit defining said second cross sectional flow area therethrough.

3. The exhaust flow restriction arrangement of claim 1 wherein said passive flow restriction member is disposed in line with said second engine exhaust conduit;

and wherein said passive flow restriction member comprises a section of said second engine exhaust conduit defining said second cross sectional flow area therethrough.

4. The exhaust flow restriction arrangement of claim 1 wherein said passive flow restriction member includes a plate member disposed within either of said first and second engine exhaust conduits, said plate member having an orifice extending therethrough defining said second cross sectional flow area.

5. The exhaust flow restriction arrangement of claim 1 wherein said second cross sectional area is sized to further optimize fuel economy associated with said engine.

6. A passive engine exhaust flow restriction arrangement, comprising:

a turbocharger having a turbine defining a turbine inlet operable to receive exhaust gas produced by an internal combustion engine and a turbine outlet operable to expel engine exhaust gas therefrom;

an exhaust conduit disposed in fluid communication between an exhaust manifold of said engine and said turbine inlet, said exhaust conduit defining a third cross sectional flow area therethrough;

an EGR conduit fluidly coupled between said exhaust conduit and an intake manifold of said engine, said EGR conduit supplying recirculated exhaust gas to said intake manifold; and a passive flow restriction member disposed in line with said exhaust conduit downstream of said EGR conduit and defining a second fixed cross sectional flow area therethrough less than said third cross sectional flow area, said second cross sectional flow area sized to reduce an operational efficiency of said turbine to thereby allow increased flow of said recirculated exhaust gas through said EGR conduit.

7. The exhaust flow restriction arrangement of claim 6 wherein said passive flow restriction member comprises a section of said exhaust conduit defining said second cross sectional flow area therethrough.

8. The exhaust flow restriction arrangement of claim 6 wherein said passive flow restriction member includes a plate member disposed within said exhaust conduit, said plate member having an orifice extending therethrough defining said second cross sectional flow area.

9. The exhaust flow restriction arrangement of claim 6 wherein said second cross sectional area is sized to further optimize fuel economy associated with said engine.

10. A passive engine exhaust flow restriction arrangement, comprising:

a turbocharger having a turbine defining a turbine inlet operable to receive exhaust gas produced by an internal combustion engine and a turbine outlet operable to expel engine exhaust gas therefrom;

a first exhaust conduit disposed in fluid communication between said turbine outlet and ambient, said first exhaust conduit defining a first cross sectional flow area therethrough;

a second exhaust conduit disposed in fluid communication between an exhaust manifold of said engine and said turbine inlet;

an EGR conduit fluidly coupled between said second exhaust conduit and an intake manifold of said engine, said EGR conduit supplying recirculated exhaust gas to said intake manifold; and a passive flow restriction member disposed in line with said first exhaust conduit and defining a second fixed cross sectional flow area therethrough less than said first cross sectional flow area, said second cross sectional flow area sized to reduce an operational efficiency of said turbine to thereby allow increased flow of said recirculated exhaust gas through said EGR conduit.

11. The exhaust flow restriction arrangement of claim 10 wherein said passive flow restriction member comprises a section of said exhaust conduit defining said second cross sectional flow area therethrough.

12. The exhaust flow restriction arrangement of claim 10 wherein said passive flow restriction member includes a plate member disposed within said exhaust conduit, said plate member having an orifice extending therethrough defining said second cross sectional flow area.

13. The exhaust flow restriction arrangement of claim 10 wherein said second cross sectional area is sized to further optimize fuel economy associated with said engine.

* * * * *